US006015139A

United States Patent [19]

Weber

[11] Patent Number: 6,015,139

[45] Date of Patent: Jan. 18, 2000

[54] ANCHOR FOR GUARD RAIL SYSTEM ON STRUCTURAL GRATING FLOORS

[76] Inventor: Herbert Weber, 2604 Sandpiper Drive, Kamloops British Columbia, Canada, V2B 6G2

[21] Appl. No.: 08/893,920

[22] Filed: Jul. 11, 1997

[51] Int. Cl.[7] ..... E04H 17/00

[52] U.S. Cl. ..... 256/65; 256/69; 256/DIG. 6; 52/704; 52/298

[58] Field of Search ..... 256/65, 59–68, 256/69, DIG. 6, 24; 52/298, 165, 704; 248/523, 222.52, 500; 182/113; 411/551, 349, 552

[56] References Cited

U.S. PATENT DOCUMENTS

| | | | |
|---|---|---|---|
| 1,253,494 | 1/1918 | James | 52/298 X |
| 2,627,176 | 12/1953 | Levy | 52/704 X |
| 3,311,333 | 3/1967 | Galloway | 52/298 X |
| 4,422,275 | 12/1983 | Baetje | 52/704 X |
| 4,480,819 | 11/1984 | Lopez | 256/1 |
| 4,776,143 | 10/1988 | Pointner | 52/704 X |
| 4,830,341 | 5/1989 | Arteau et al. | 256/65 |
| 5,161,425 | 11/1992 | Baskett et al. | 280/775 X |

FOREIGN PATENT DOCUMENTS 1811554 4/1993 Russian Federation .

*Primary Examiner*—Lynne H. Browne
*Assistant Examiner*—John R. Cottingham
*Attorney, Agent, or Firm*—Christie, Parker & Hale, LLP

[57] ABSTRACT

An anchor system for removably mounting a stanchion to a grating floor formed from spaced grating members comprising a plate having upper and lower surfaces, a mounting location on the upper surface for releasably supporting the stanchion, and at least one locking member extending from the lower surface to releasably lock the plate to the grating floor. The locking member is formed with an extension adapted for movement from a position that allows the extension to be introduced between and below the spaced grating member to a position in which extension engages beneath one or more grating members to lock the plate onto the grating floor.

14 Claims, 4 Drawing Sheets

ANCHOR FOR GUARD RAIL SYSTEM ON STRUCTURAL GRATING FLOORS

FIELD OF THE INVENTION

This invention relates to an anchor for removably mounting a guard rail system to a grating floor.

BACKGROUND OF THE INVENTION

Guard rails or fencing are commonly used adjacent locations that present a danger to an individual's safety or to risk of falling. For example, rails or fencing are often installed at the edges of elevated floors, about access openings in a floor or about openings in a floor to accommodate staircases between floors. As well, rails or fencing can be used to create a barrier about operating equipment to prevent an individual from accidentally contacting the equipment.

These guard rails or fences usually comprise horizontal members that are joined to spaced vertical stanchions that are permanently anchored in place. Labour and materials costs for installing such safety barriers can be expensive.

Temporary or removable guards rails have also been developed chiefly for use on construction sites to provide for safety of workers. An advantage of these temporary guard rails is that they are much less expensive to erect than permanent railings, however, they tend not to be as sturdy. Examples of prior temporary guard rail systems include U.S. Pat. No. 4,830,341 to Arteau et al. and Russian Patent 1811554-A3.

U.S. Pat. No. 4,830,341 discloses an anchor for a temporary safety fence at a building construction site comprising a plate that is bolted directly to a concrete type floor surface. The plate includes an upright sleeve to receive the stanchion of a guard rail.

Russian Patent 1811554-A3 discloses a temporary safety barrier that includes a stanchion that is wedge fitted into a specially formed conical hole in the floor.

Both these designs rely on drilling or forming holes in the surface on which the guard rail is supported. At a construction site, this does not present much of a drawback as the holes can be patched over as construction is completed. However, these designs are not generally appropriate for temporary use at sites other than construction sites as they leave unsightly anchoring holes visible when they are removed. The drilling of holes may also affect the structural integrity of the surface to which the guard rails are mounted.

In many industrial sites, grating floors comprising an array of longitudinal, spaced and parallel grating members joined by transverse cross members are used to create relatively inexpensive raised floors and catwalks for accessing equipment. Applicant has developed an anchor for a guard rail system that can be releasably attached to the grating floor using a novel anchor plate.

SUMMARY OF THE INVENTION

The anchor of the present invention does not require the drilling of mounting holes or otherwise alter the existing grating floor thereby avoiding the marking which are the problems of the prior art and maintaining the structural integrity of the grating floor.

Accordingly, the present invention provides an anchor for removably mounting a stanchion to a grating floor formed from spaced grating members comprising:

a plate having upper and lower surfaces;

a mounting location on the upper surface for releasably supporting the stanchion;

at least one locking member extending from the lower surface and formed with an extension adapted for movement from a position that allows the extension to be introduced between and below the spaced grating member to a position in which extension engages beneath one or more grating members to releasably lock the plate onto the grating floor.

The anchor is quickly installable on the grating floor to provide a sturdy and reliable mounting point to support a guard rail stanchion. Removal of the anchor is also quick.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
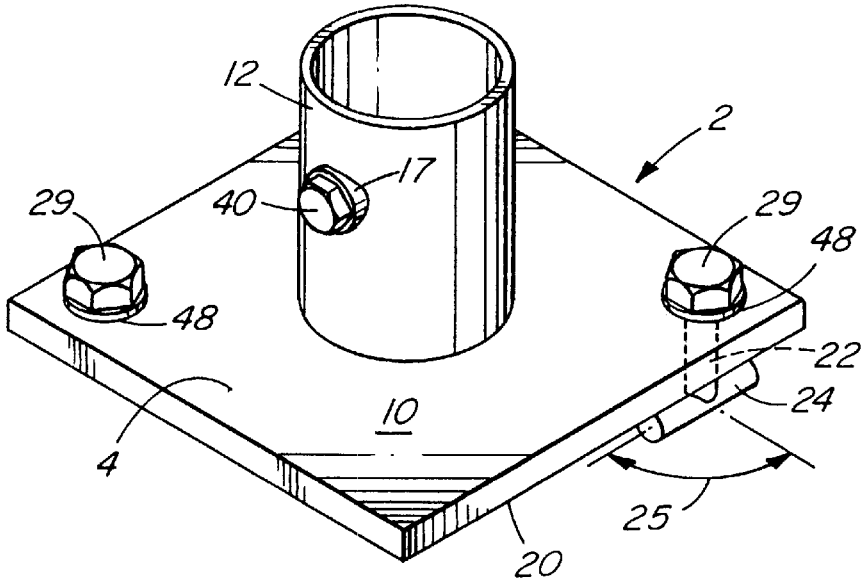
FIG. 1 is a perspective view of a preferred embodiment of the anchor of the present invention.
Figure 2:
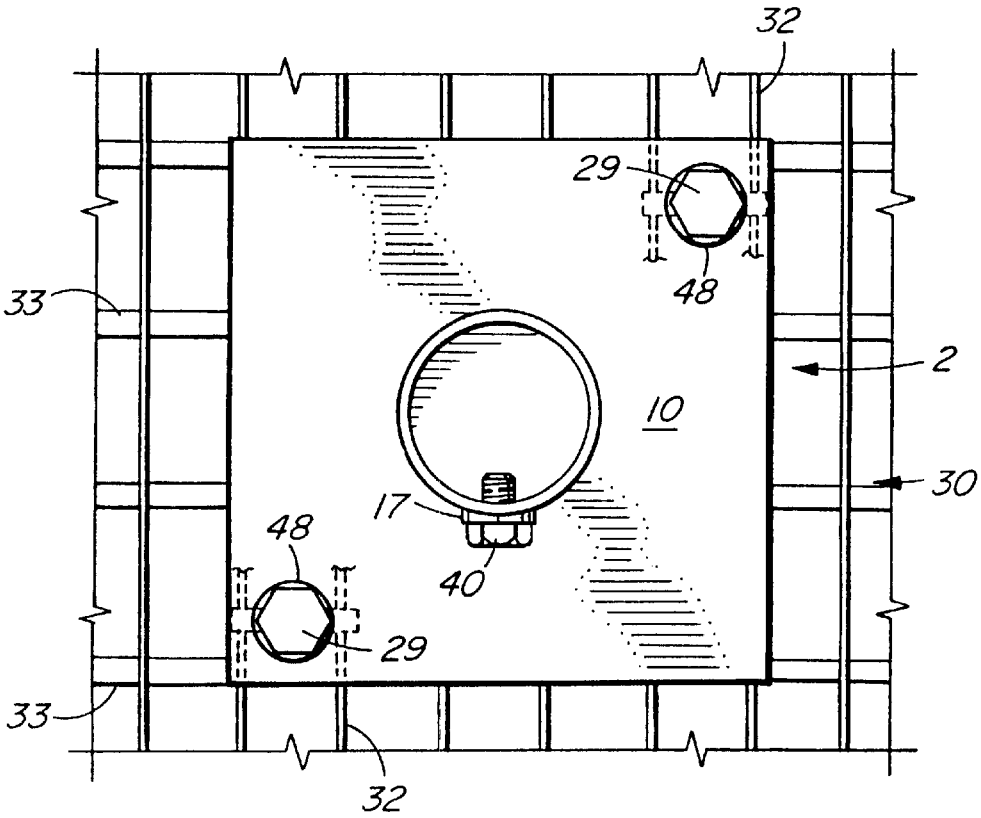
FIG. 2 is a plan view of the anchor of FIG. 1.
Figure 3:
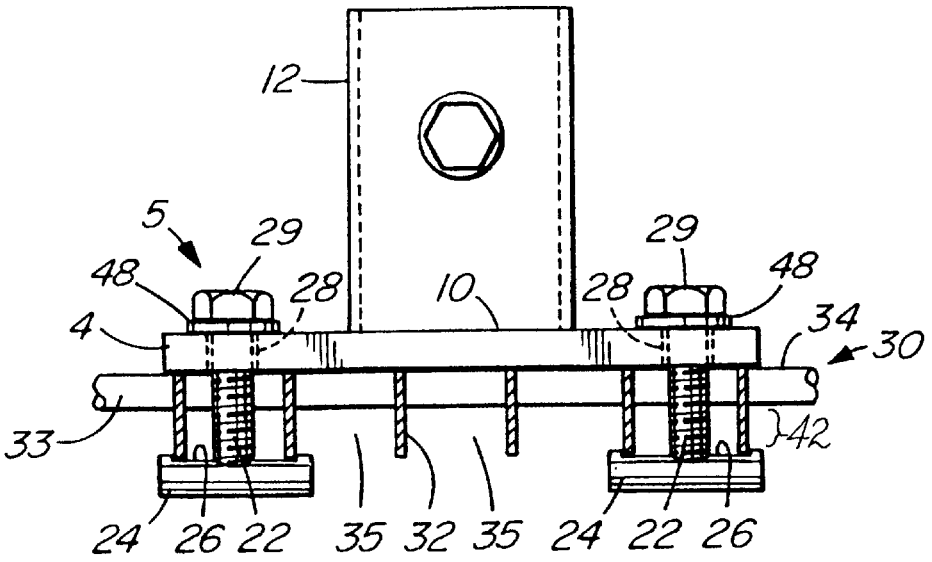
FIG. 3 is a side elevation view of the anchor of FIG. 1.
Figure 6:
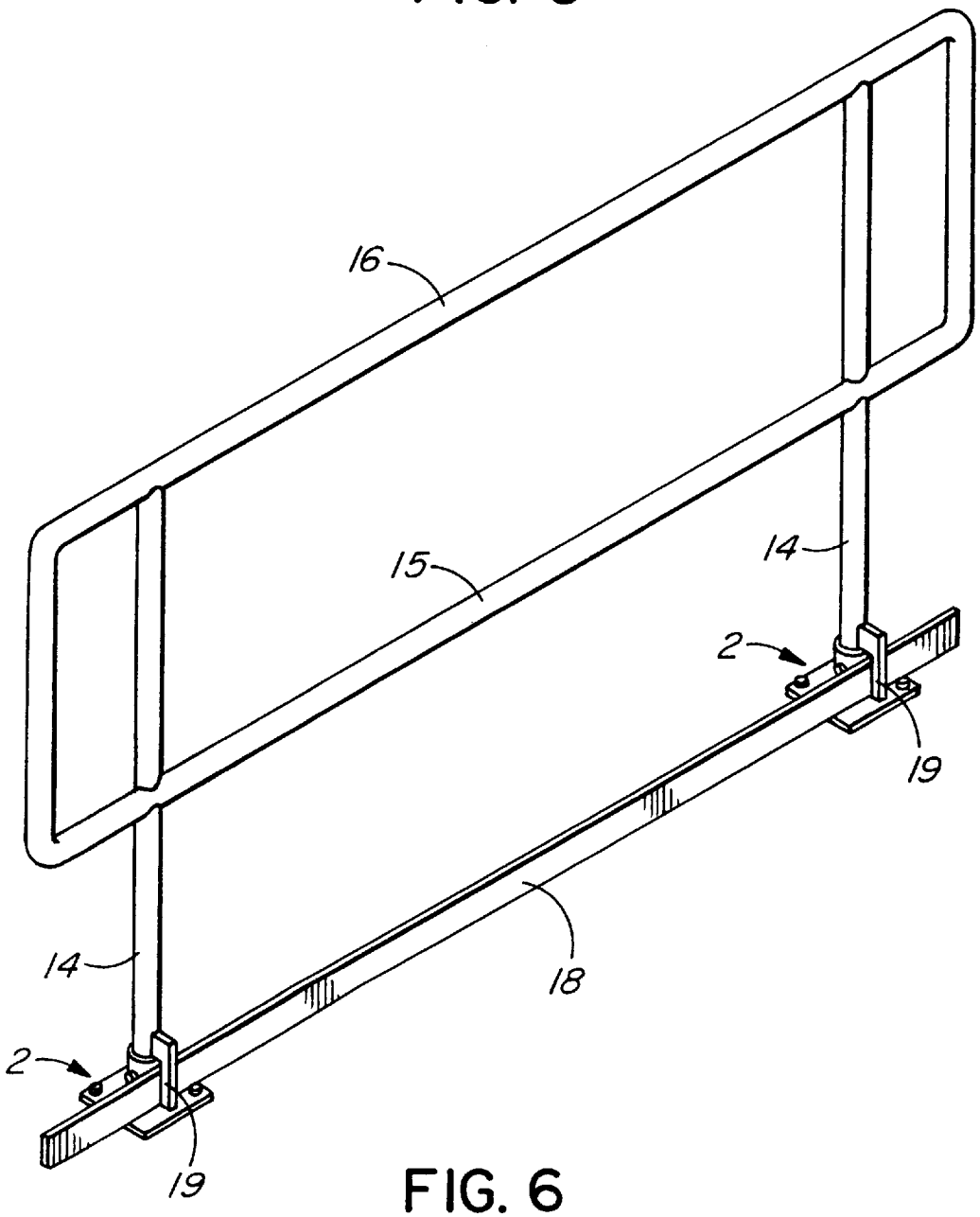
FIG. 6 is a perspective view of a guard rail system for use with the anchor of the present invention.
Figure 7:
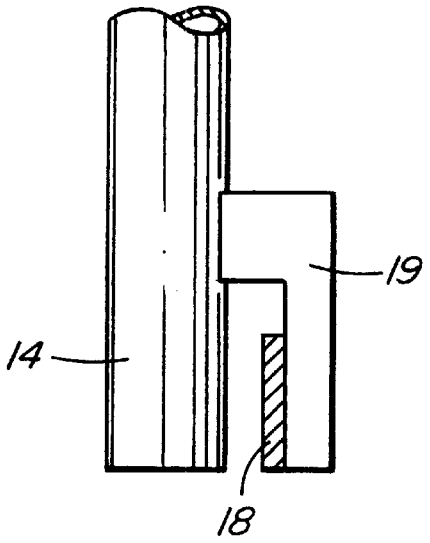
FIG. 7 is a detailed view with cutaway sections of the guard rail.

Referring to FIGS. 1, 2 and 3, there is shown an anchor 2 for removably mounting a guard rail stanchion to a grating floor according to preferred embodiments of the present invention. The anchor comprises a generally rectangular plate 4 having an upper surface 10 and a lower surface 20. Upper surface 10 includes a mounting location in the form of upstanding sleeve 12 adapted to releasably receive and support a guard rail stanchion 14 as shown in FIGS. 6 and 7.

Anchor 2 is designed to be removably locked into place on a grating floor 30 as best shown in FIGS. 2 and 3. As is conventional, grating floor 30 is formed from a series of spaced, parallel elongate grating members 32 that form a framework that supports transverse rods 33 that define a floor surface 34 on which the anchor plate rests. Between adjacent grating members 32 and adjacent transverse members 33, grating floor 30 is divided into a series of open cells 35.

Plate 4 of anchor 2 is releasably mountable to grating 30 by at least one locking member 5 that extends downwardly from lower surface 20 of the plate. Preferably, each locking member 5 comprises a downwardly depending post 22 formed with an extension in the form of a transverse member 24 at the distal end of the post. Transverse member 24 is rigidly attached to the distal end of post 22 and the post is mounted to the plate for rotatable movement between a released position that allows the transverse member 24 to be introduced between and below the spaced grating members 32 and a locked position in which transverse member 24 engages beneath the grating members to releasably lock the plate onto the grating floor. FIG. 3 shows posts 22 in the locked position with transverse members 24 parallel to grating transverse members 33. FIG. 1 shows posts 22 in the released position in which transverse members 24 are parallel to grating members 32. Posts 22 are rotated through ninety degrees as indicated by arrow 25 in FIG. 1 to move between the released and locked positions. Preferably, each transverse member is formed with notches 26 adjacent post 22 to receive the lower edges of grating members 32 to ensure secure engagement of the plate to the grating floor.

In the illustrated embodiment, generally rectangular plate 4 is shown with two locking members at opposite corners of a diagonal. This ensures a secure locking engagement of the plate with the grating floor. It will be readily apparent to a person skilled in the art that a single locking member or more than two locking members can be used.

Posts 22 extend through apertures 28 in plate 4 to permit rotatable movement of the posts with respect to the plate. Each post member includes a head portion 29 accessible from upper surface 10 of plate 4 to permit rotation of the post and the attached transverse member between the released position and the locked position. Preferably, head portion 29 is formed to receive a wrench or other appropriate tool to facilitate rotation.

Figure 4:
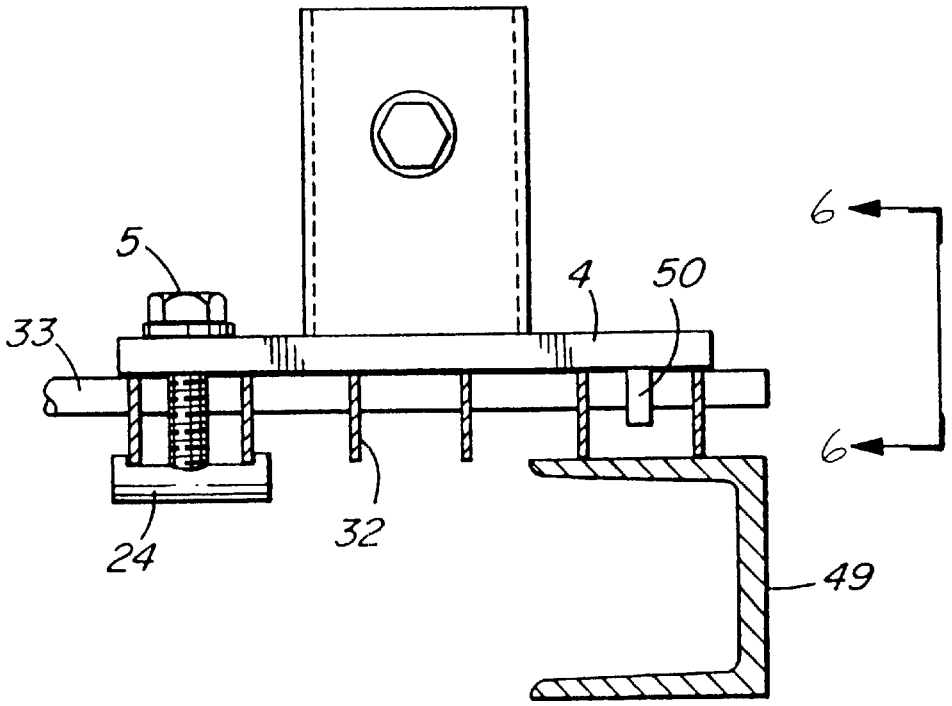
FIG. 4 is a side elevation view of a further embodiment of the present invention including a hook to engage with a grating member.
Figure 5:
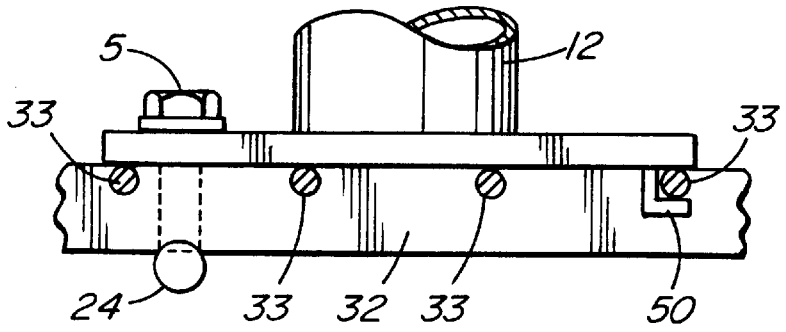
FIG. 5 is a further view of the embodiment of FIG. 4 taken along line 6—6 of FIG. 4.

In some cases, the anchor of the present invention will be installed at a location such as the edge of a grating floor as illustrated in FIGS. 4 and 5. FIG. 5 is an end view of the edge of the grating floor taken along line 6—6 of FIG. 4. The presence of a structural supporting beam 49 at the grating floor edge prevents the locking engagement of the previously described locking members 5 in this region. To avoid this problem, applicant has developed an anchor as illustrated in FIGS. 4 and 5 that uses a locking member 5 as described above in combination with a hook 50 to anchor plate 4 into place. Hook 50 extends from the lower surface of plate 4 and is oriented to engage below a transverse rod member 33. Hook 50 is preferably positioned on a diagonal from locking member 5. Hook 50 is engaged beneath a transverse rod member 33 by moving plate 4 into position at an angle to the floor and then lowering plate 4 into position on the floor surface so that locking member 5 can be engaged.

Once plate 4 is locked into place on grating floor 30, a stanchion 14 of a guard rail assembly is inserted into upstanding sleeve 12. FIG. 6 illustrates a typical guard rail unit suited for use with the present invention comprising a pair of generally vertical stanchions 14 that support upper and lower horizontal rails 15 and 16. In addition, a kick plate 18 is provided adjacent the floor to prevent objects from being accidentally knocked over or kicked over an edge. As best shown in FIG. 7, kick plate 18 is offset from stanchion 14 by inverted L-shaped bracket 19 to provide clearance for the lower end of stanchion 14 to be inserted into sleeve 12.

Preferably, sleeve 12 is formed with a retaining element in the form of bolt 40 which is tightenable through the side wall of the sleeve to bear against stanchion 14 and releasably lock the stanchion into the sleeve. A nut 17 is welded onto the sleeve to threadably receive bolt 40.

The anchor of the present invention is adjustable to accommodate grating floors of different thickness 42 (FIG. 3). Biasing means associated with the locking members are used to lengthen or shorten the portion of post 22 that extends from lower surface of plate 4 so that the transverse members are always in contact with the lower edge of grating members 32 when the posts are in their locked position.

As shown in the embodiments of FIGS. 1, 2 and 3, the biasing devices are spring washers 48 positioned between the head portion 29 of the post member and upper surface of plate 4 to urge the post member upwardly and shorten the post member so that transverse members 24 snugly engage below grating members 32. Alternatively, a helical spring can be substituted for spring washer 48 to accomplish the same function.

Figure 8:
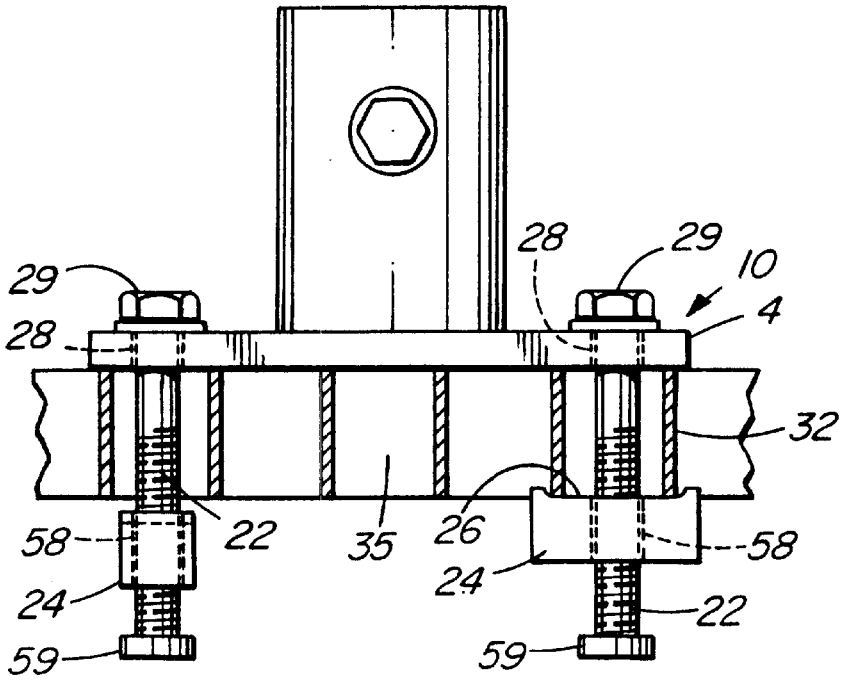
FIG. 8 is a detailed view of an alternative system for adjusting the length of a post member to accommodate grating members of different thicknesses.

A further arrangement to permit adjustment of post member 22 to accommodate grating members of different thicknesses is illustrated in detail in FIG. 8. The post member 22 on the left is shown rotated to the released position while the post member 22 on the right is shown in the locked position. Each post member 22 is threaded and transverse member 24 is formed with a correspondingly threaded aperture 58 to permit rotatable movement of transverse member 24 along post member 22. Rotation of transverse member 24 permits adjustment of the distance between the transverse member and the lower surface of the plate to adjust for the thickness of the grating member 32 prior to inserting posts 22 into and through cells 35. Preferably, each post member 22 is formed with a stop member 59 welded to the end of the post to prevent transverse member 24 from being accidently threaded off post member 22.

Although the present invention has been described in some detail by way of example for purposes of clarity and understanding, it will be apparent that certain changes and modifications may be practiced within the scope of the appended claims.

I claim:

1. An anchor for removably mounting a stanchion to a grating floor formed from spaced grating members comprising:

a plate having upper and lower surfaces;

a mounting location on the upper surface for releasably supporting the stanchion;

at least one locking member comprising a post extending from the lower surface with a threaded portion and a transverse member formed with notches, the transverse member being threadably receivable on the threaded portion for rotation to permit relative movement of the transverse member with respect to the post for adjustment of the distance between the transverse member and the lower surface of the plate to accommodate grating members of different dimensions, the locking member being adapted for movement between a released position that allows the post and transverse member to be introduced between and below the spaced grating members and a locked position in which the transverse member is able to engage beneath one or more of said grating members with the notches of the transverse member able to receive the grating members to releasably lock the plate onto the grating floor.

2. An anchor as claimed in claim 1 in which the mounting location comprises a sleeve extending from the upper plate surface to receive the stanchion.

3. An anchor as claimed in claim 2 wherein the sleeve includes a retaining element to releasably lock the stanchion to the plate.

4. An anchor as claimed in claim 1 including a hook extending downwardly from the lower surface to engage a grating member.

5. An anchor as claimed in claim 1 in which the transverse member is rigidly attached to a distal end of the post and the post is mounted to the plate for rotatable movement between the released position and the locked position.

6. An anchor as claimed in claim 1 in which the post includes a head portion accessible from the upper surface to permit rotation of the post and the transverse member between the released position and the locked position.

7. An anchor as claimed in claim 1 in which the plate is formed with an aperture through which the post extends for rotatable movement and the post includes a head portion accessible from the upper surface to permit rotation of the post and the transverse member between the released position and the locked position.

8. An anchor as claimed in claim 7 in which the post is threaded and the transverse member is adapted to be threadably received on the post for rotation whereby rotation of the transverse member on the post permits adjustment of the distance between the transverse member and the lower surface of the plate to allow for engagement with the grating members of different dimensions.

9. An anchor as claimed in claim 1 including a stop at the distal end of the post to prevent removal of the transverse member from the post.

10. An anchor as claimed in claim 1 including a biasing device to urge the transverse member into contact with the grating member.

11. An anchor as claimed in claim 10 in which the biasing device comprises a spring washer positioned between the head portion of the post and the upper surface of the plate.

12. An anchor as claimed in claim 10 in which the biasing device comprises a shim insertable between the head portion of the post and the upper surface of the plate.

13. An anchor for removably mounting a stanchion to a grating floor formed from spaced grating members comprising:

a plate having upper and lower surfaces;

a mounting location on the upper surface for releasably supporting the stanchion; and at least one locking member extending from the lower surface of the plate and formed with an extension adapted for movement between a released position that allows the extension to be introduced between and below the spaced grating members and a locked position in which the extension engages beneath one or more said grating members to releasably lock the plate onto the grating floor, the at least one locking member comprising a downwardly depending post and the extension comprising a transverse member at a distal end of the post formed with notches to receive the grating members, the plate being formed with an aperture through which the post extends for rotatable movement and the post including a head portion accessible from the upper surface to permit rotation of the post and the attached transverse member between the released position and the locked position, and the post being threaded and the transverse member being adapted to be threadably received on the post for rotation whereby rotation of the transverse member on the post permits adjustment of the distance between the transverse member and the lower surface of the plate to allow for engagement with said grating members of different dimensions.

14. An anchor for removably mounting a stanchion to a grating floor formed from spaced grating members comprising:

a plate having upper and lower surfaces;

a mounting location on the upper surface for releasably supporting the stanchion;

at least one locking member extending from the lower surface of the plate and formed with an extension adapted for movement between a released position that allows the extension to be introduced between and below the spaced grating members and a locked position in which the extension engages beneath one or more said grating members to releasably lock the plate onto the grating floor, the at least one locking member comprising a downwardly depending post and the extension comprising a transverse member at a distal end of the post formed with notches to receive the grating members, the plate being formed with an aperture through which the post extends for rotatable movement and the post including a head portion accessible from the upper surface to permit rotation of the post and the attached transverse member between the released position and the locked position, and the post being threaded and the transverse member being adapted to be threadably received on the post for rotation whereby rotation of the transverse member on the post permits adjustment of the distance between the transverse member and the lower surface of the plate to allow for engagement with said grating members of different dimensions; and a stop at the distal end of the post to prevent removal of the transverse member from the post.

* * * * *